US005899391A

United States Patent [19]

Goehner et al.

[11] Patent Number: 5,899,391

[45] Date of Patent: May 4, 1999

[54] CYCLONIC PROCESSING SYSTEM

[75] Inventors: John Carl Goehner, Vancouver, Wash.; Bruce J. Shaw, Portland, Oreg.

[73] Assignee: Hudnut Industries Inc., Portland, Oreg.

[21] Appl. No.: 08/971,182

[22] Filed: Nov. 17, 1997

[51] Int. Cl.[6] ..... B02C 19/06

[52] U.S. Cl. ..... 241/5; 241/39

[58] Field of Search ..... 241/5, 34; 209/1, 209/11, 716, 717, 722

[56] References Cited

U.S. PATENT DOCUMENTS

| | | | |
|---|---|---|---|
| 1,250,553 | 12/1917 | Bryan . | |
| 2,199,015 | 4/1940 | Toensfeldt | 34/34 |
| 2,394,605 | 2/1946 | Friedman | 34/57 |
| 3,315,371 | 4/1967 | Glatt et al. | 34/82 |
| 3,360,866 | 1/1968 | Shirai | 34/10 |
| 3,675,401 | 7/1972 | Cordes | 55/394 |
| 3,788,044 | 1/1974 | McNeil | 55/204 |
| 3,802,570 | 4/1974 | Dehne | 210/304 |
| 3,882,034 | 5/1975 | Gibbons | 252/99 |
| 3,901,799 | 8/1975 | Adkison | 209/144 |
| 4,224,143 | 9/1980 | Liller | 209/211 |
| 4,236,321 | 12/1980 | Palmonari et al. | 34/57 |
| 4,317,716 | 3/1982 | Liller | 209/211 |
| 4,364,822 | 12/1982 | Rich, Jr. | 209/3 |
| 4,414,100 | 11/1983 | Krug et al. | 208/153 |
| 4,421,594 | 12/1983 | Bildjukevich et al. | 159/4 |
| 4,431,405 | 2/1984 | Eatherton | 432/72 |
| 4,507,197 | 3/1985 | Koenig et al. | 209/2 |
| 4,579,525 | 4/1986 | Ross | 432/13 |
| 4,627,173 | 12/1986 | O'Hagan et al. | 34/10 |
| 4,664,889 | 5/1987 | Steenge et al. | 422/147 |
| 4,750,677 | 6/1988 | Taylor | 241/5 |
| 4,771,708 | 9/1988 | Douglass, Jr. | 110/233 |
| 4,888,884 | 12/1989 | Bartling et al. | 34/32 |
| 5,294,002 | 3/1994 | Moses | 209/135 |
| 5,525,239 | 6/1996 | Duske | 210/739 |
| 5,565,164 | 10/1996 | Goehner et al. | 264/321 |
| 5,577,670 | 11/1996 | Omata et al. | 241/5 |

*Primary Examiner*—Joseph J. Hail, III
*Assistant Examiner*—William Hong
*Attorney, Agent, or Firm*—Chernoff, Vilhauer, McClung & Stenzel, LLP

[57] ABSTRACT

A cyclonic processing system accepts unprocessed fragmentary material of a predetermined aerodynamic buoyancy range, keeps it suspended in a vortex and discharges it when it reaches a finished material aerodynamic buoyancy range. The cyclonic processing apparatus and method dries, mills, separates and/or mixes fragmentary material. The waste air from the apparatus is reduced in particle content. The apparatus and method may be used to process post consumer waste for recycling. Additionally, it may be used to harness waste heat from industrial processes.

14 Claims, 3 Drawing Sheets

CYCLONIC PROCESSING SYSTEM

BACKGROUND OF THE INVENTION

The present invention is a cyclonic system for processing fragmentary material to produce one or more end products having substantially uniform fragment size and/or aerodynamic buoyancy. Because aerodynamic buoyancy is related to moisture content, the cyclonic processing system may be used for drying moisture bearing fragmentary material.

Many industrial and agricultural processes yield fragments that are either too wet, too large or too varied in size, density, or composition to be of great utility. Of particular interest are post-consumer fragmentary materials gathered in recycling efforts, which are typically formed of more than one substance. Separating out the constituent substances from a mass of multi-substance fragments permits the separate collection and reuse of the substances.

An interesting example of a fragmentary material having nonuniformities that reduce its utility is provided by "hog fuel," as that term is used in the lumber industry. In this instance "hog fuel" is actually a mixture of wooden chips and bark that is typically a waste product of lumber mills. Hog fuel is typically fed into a "hog fuel boiler," to produce steam for use in various lumber and paper mill operations Although the hog fuel is typically predried in a continuous feed rotary drum dryer, hog fuel boilers are nevertheless plagued by hog fuel moisture and fragment size inconsistency. A wetter than usual mass of hog fuel or a large clump of saw dust mixed into the hog fuel can extinguish the boiler fire.

An example of multi-substance fragments is provided by plastic one quart oil containers gathered for recycling. Typically the exterior of a plastic oil container bears a heat set polymer label. The label is made of a different type of polymer from the container so that the label must be separated from the container in order for an apparatus to separately collect the two different polymers for reuse. The containers must also be washed of oil residue and dried in order to avoid contaminating either polymer end product with oil or water.

Unfortunately, the above described tasks present a great challenge to one using the current technology. The drying potentially could be performed by a continuous feed rotary drum dryer. Rotary drum dryers, however, generate waste air that typically contains particles that should be removed before discharge into the atmosphere. This necessitates the use of pollution control equipment and the acquisition of a permit from the local pollution control agency. The particles also hamper efforts to recirculate the air back into the dryer as they tend to jam the recirculating air blower and contaminate the fragments being dried.

The separation of the constituent substances of the plastic oil containers is typically performed by cutting up the fragments and forcing the resultant subfragments against a wire mesh that catches the larger size subfragments, which are typically composed of the container polymer, and passes the smaller label subfragments. Unfortunately, the wire mesh frequently becomes clogged, thereby requiring replacement, which causes great expense and difficulty.

A patent search found no references to the use of cyclonic equipment that could be practically used to address the above noted problems in the processing of hog feed or plastic oil containers despite the fact that cyclonic equipment is fairly common in the pollution control field. A number of references describe cyclonic devices in which the fragmentary material falls through an air vortex and exits from the bottom of the device. None of the bottom exit device references, however, appear to teach the suspension of fragments in the vortex of the bottom-exit device.

Fragmentary materials that are lighter than water, such as plastic, however, become lighter still as they dry. Consequently, a bottom exit cyclonic device cannot dry lighter-than-water material to a uniform dryness because lighter-than-water material will rise in the vortex as its progressively reduced moisture content translates into increased aerodynamic buoyancy thereby avoiding a bottom exit. A bottom exit cyclonic device could be configured so that lighter-than-water material would fall quickly out of the device. This would, however, not permit much drying time and would not create a uniform aerodynamic buoyancy (i.e. dryness) in its product.

In another prior art device fragments are driven upwards and guided in a helical path by a helical baffle before entering a chamber in which they descend and exit. There is no indication, however, that any uniformity of dryness is introduced into the fragmentary mass or that the fragments are ever suspended in a vortex.

An additional reference found in the search teaches a columnar separator device in which fragments are lofted in a column by an upward draft of air and separated according to their buoyancy by a vertically spaced sequence of exit hoods and chutes. A columnar separator has only a limited precision, however, due to the jostling of the fragments in the upward draft of air. Moreover, because this device is not cyclonic it would be difficult to adapt it to effect physical changes to fragments because without suspending fragments in a vortex there is not much processing time.

U.S. Pat. No. 5,565,164, which shares co-inventor John C. Goehner with the present application, describes a cyclonic densifyer in which fragments of thermoplastic polymer are introduced into a vortex where they are softened by heat and broken and re-agglomerated until they form into fairly uniform pellets that are compact enough to precipitate from the vortex.

What is therefore needed but not yet available is a fragmentary material processing apparatus and method in which the fragments remain suspended in a vortex until reaching a predetermined aerodynamic buoyancy and/or fragment size. Among other purposes this apparatus and method is needed for drying moisture bearing fragments until a predetermined moisture results. An apparatus and method is also needed for milling, separating and mixing fragmentary material.

SUMMARY OF THE INVENTION

The present invention is a cyclonic system for processing fragmentary material to achieve a range of aerodynamic buoyancy or fragment size. A cyclonic device is used, including a vertical, substantially cylindrical chamber having a top vent, an air inlet, an unprocessed fragments inlet and a processed fragments outlet. The cyclonic device also may include a center baffle positioned within the chamber. In the method, air is introduced through the air inlet and a vortex is created within the cyclonic device. The fragmentary material is introduced into the cyclonic apparatus through the unprocessed fragments inlet and is suspended by the vortex. The suspended fragmentary material is vertically stratified upwardly according to increasing aerodynamic buoyancy (decreasing aerodynamic density) and typically radially stratifies outwardly according to increasing fragment size. Aerodynamic buoyancy is the tendency of a fragment to be lofted in an airstream. It is a function of fragment mass and the surface area which the fragment presents to the air stream.

The vortex processes the fragmentary material, changing the size or buoyancy or mixing or separating fragments. The processed fragments outlet is disposed so that material processed to the predetermined aerodynamic buoyancy or fragment size exits the chamber through the processed fragments outlet. The top vent is centrally disposed to discharge air having a reduced fragment concentration from the center of the vortex.

The foregoing and other objectives, features, and advantages of the invention will be more readily understood upon consideration of the following detailed descriptions taken in conjunction with the accompanying drawings.

DETAILED DESCRIPTION OF THE PREFERRED EMBODIMENT

Figure 1:
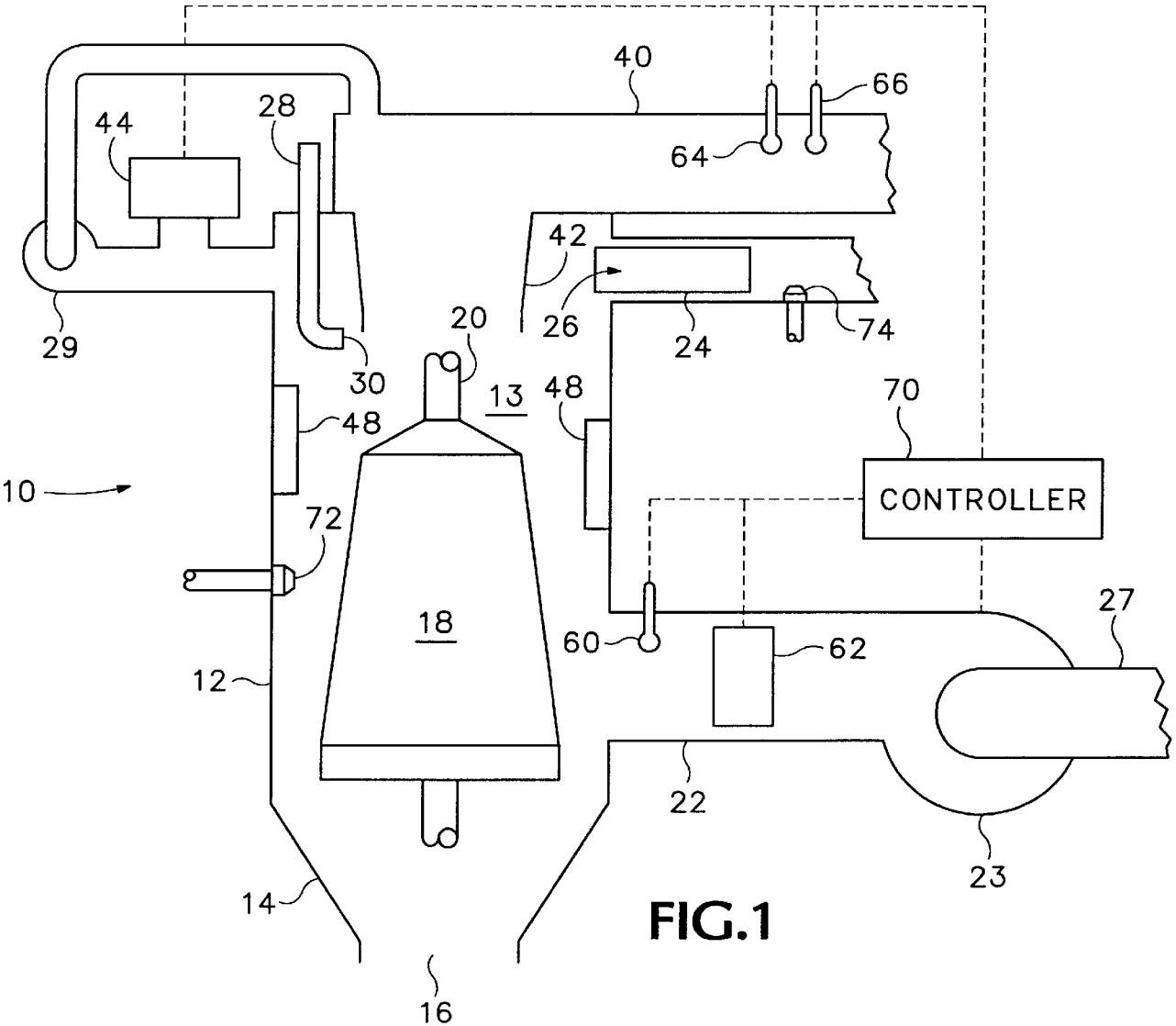
FIG. 1 is a schematic view of a cyclonic processing system according to the present invention.
Figure 2:
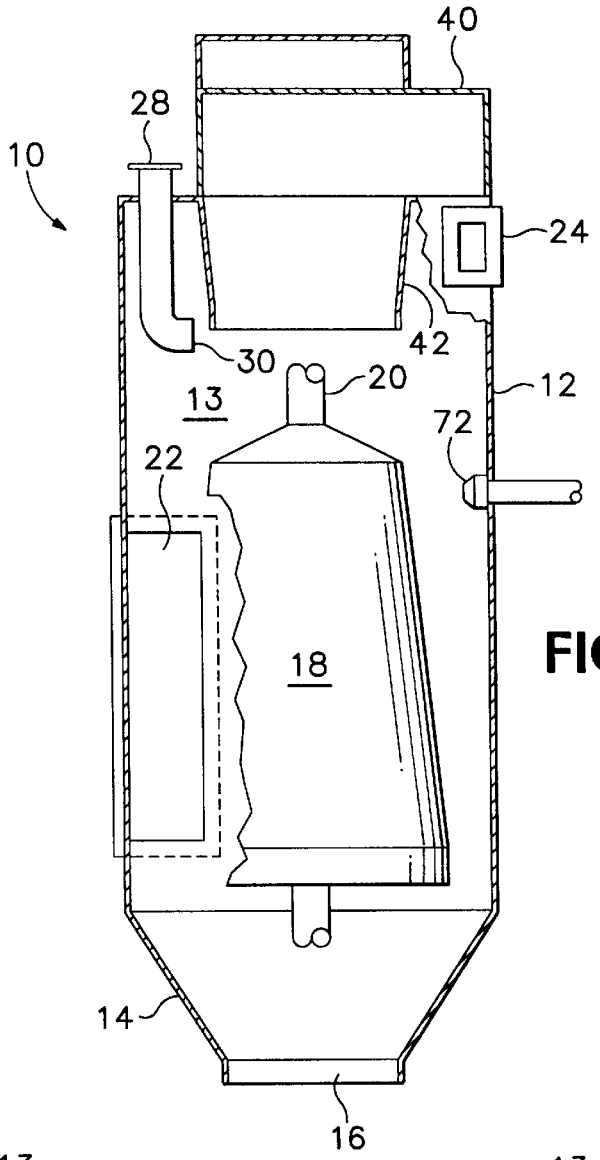
FIG. 2 is a partial side cross-sectional view of the cyclonic processing apparatus of the system of FIG. 1.
Figure 5:
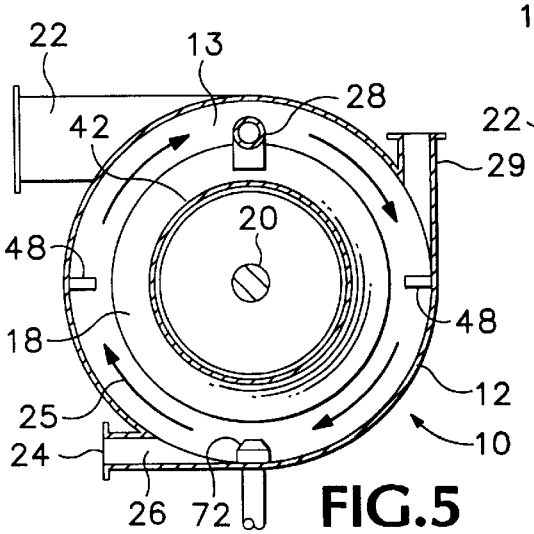
FIG. 5 is a partial top cross-sectional view of the cyclonic processing apparatus of FIG. 2 taken along line 5—5 of FIG. 2.
Figure 6:
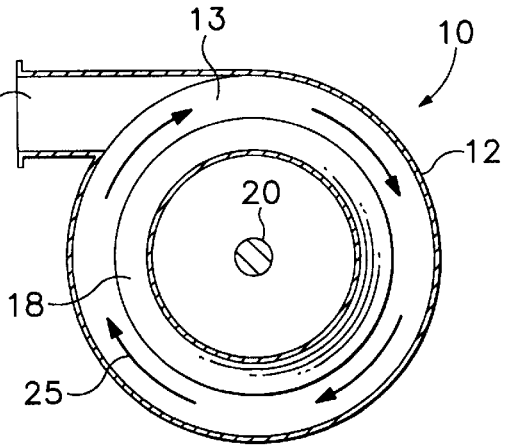
FIG. 6 is a partial top cross-sectional view of the cyclonic processing apparatus of FIG. 2 taken along line 6—6 of FIG. 2.

Referring to FIG. 1, the present invention is a cyclonic material processing system 10. An upright cylindrical wall 12 defining a chamber 13, terminates at its bottom in a discharge cone 14, preferably but not necessarily having a bottom discharge opening 16. Discharge opening 16 serves several functions, generally improving the stability of system 10 by permitting a flow of air to equalize pressure within chamber 13. In some processes, large or dense fragments introduced into chamber 13 may fall out through opening 16.

A vertically adjustable center baffle 18 may be suspended in chamber 13 by support pole 20. A vertical adjustment to baffle 18 may be effected before system 10 operation in order to tune system 10 to the prospective processing task. Air inlet 22, located near the bottom of cylinder 12 permits the rapid flow of air into chamber 13 from inlet blower 23 (FIG. 1) which combines ambient air with air from air source 27. Air source 27 may be the exhaust vent of a boiler or even top vent 40 of system 10. Air flows from air inlet 22 about baffle 18 to form a vortex 25.

Fragments are introduced into vortex 25 via unprocessed fragment blower channel 29 and stratify outwardly by increasing fragment size and upwardly by increasing aerodynamic buoyancy. This permits the removal of fragments that have reached a particular fragment size and aerodynamic buoyancy to be removed by means of a side exit skimmer 24. Skimmer 24 is a tube extending into chamber 13 and having a skimmer opening 26 that is oriented into the flow of vortex 25 at the point where fragments having a first desired aerodynamic buoyancy and fragment size are circulating in vortex 25. Opening 26 may be fixed in vertical position, but is typically adjustable horizontally.

An additional exit opening is provided by an adjustable L-shaped particle capture tube 28 that is adjustable vertically and rotatable so that the horizontal portion rotates about the vertical portion. A tube opening 30 may thereby be positioned in the flow of fragments so that the fragments of a second desired aerodynamic buoyancy and fragment size will exit through opening 30. A top vent 40 is located at the center of the top of cylinder 12 to tap into the particle-free environment at the center of vortex 25. A top vent truncated cone 42 extends into cylinder 12 to further isolate vent 40 from the particles in vortex 25.

An unprocessed fragment feed conveyer 44 feeds the fragments into a fragment feed blower channel 29, from which the fragments are pushed into chamber 13 by a rapid flow of air. The air pressure in channel 29 is isolated from the atmosphere by an air lock system (not shown).

Fragments borne in vortex 25 repeatedly strike a pair of milling paddles 48, thereby effecting a physical transformations. In a drying operation the collision between a fragment and a milling paddle helps to drive moisture out of the fragment. In processing fragments comprised of different substances, the milling paddles help to break the fragments down to their constituent substances.

Perhaps the most common, but not the sole, application for system 10 is for the drying of materials. In this type of application air source 27 is typically a heated air source, such as a boiler vent. In addition auxiliary air heater 62 is provided to help control the heat and humidity in chamber 13.

In a drying operation, the temperature instrumentation of system 10 is of particular importance. The air inlet temperature is measured by an air inlet thermistor 60. Both a wet bulb thermistor 64 and a dry bulb thermistor 66 measure the temperature of the air from top vent 40.

Dry bulb thermistor 64 measures the exit air temperature without reference to the moisture content of the air. Wet bulb thermistor 66 measures the exit air temperature reduced as a function of the dryness of the air, as one would find with a thermometer covered by a wetted wick and cooled by evaporation. At 100% relative humidity the temperature measurements of dry bulb thermistor 64 and wet bulb thermistor 66 are the same.

The measurements from thermistors 60, 64 and 66 are sent to controller 70 which adjusts the inlet heater 62, air inlet blower 23 and material feed 44 in response to the temperature values.

When drying some fragmentary materials there is a danger of combustion if the temperature rises too high or if the humidity falls too low. It is particularly difficult to control the humidity inside chamber 13 because of the variations in moisture typically encountered in the stream of feed material. When the wet bulb thermistor 66 to dry bulb thermistor 64 measurement ratio indicates that the humidity inside chamber 13 is approaching a dangerously low level, an atomizer 72 introduces water into chamber 13.

Fragments may be introduced into chamber 13 through air inlet 22 and/or through fragment feed blower channel 29. This permits processing system 10 to mix together two different types of fragments. In addition an exit sprayer 74 permits the treatment of exiting fragments with various materials.

Figure 3:
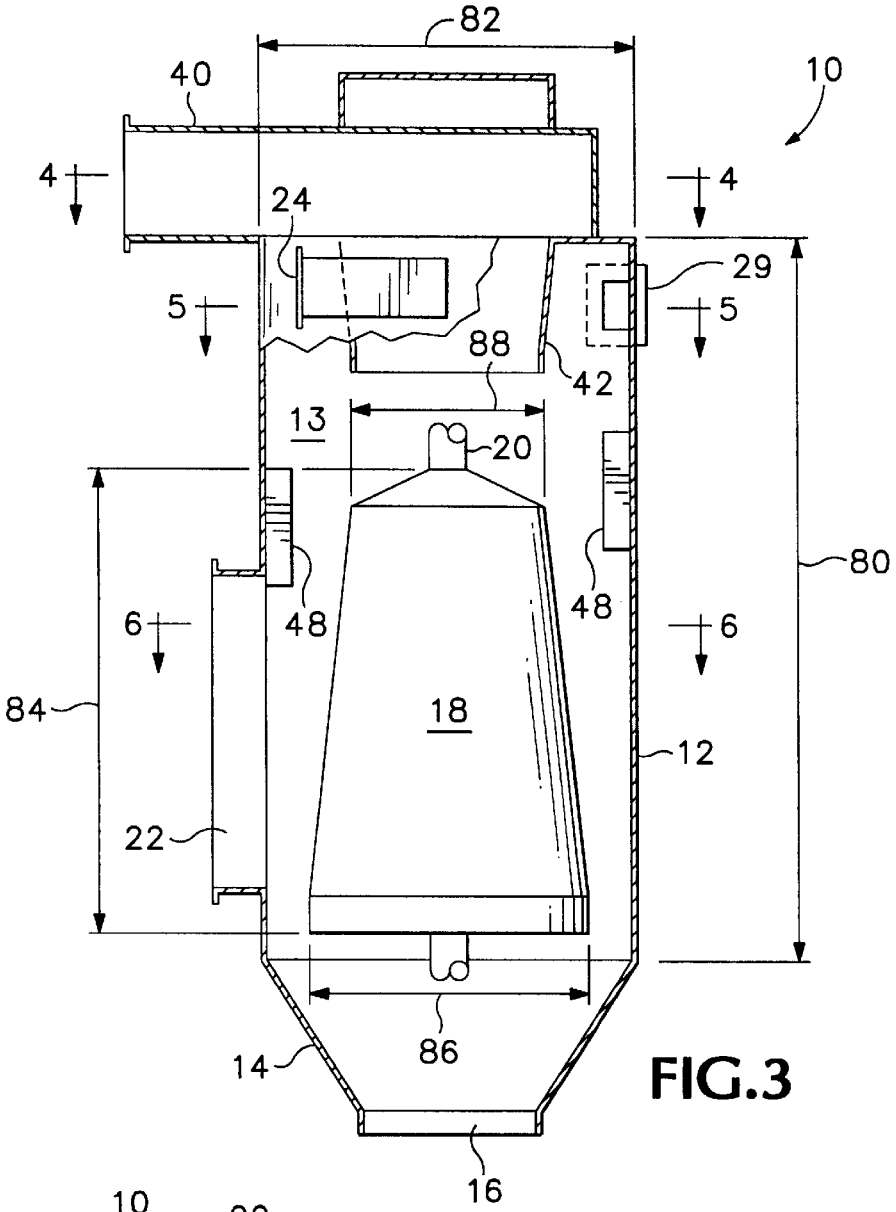
FIG. 3. is a partial side cross-sectional view of the cyclonic processing apparatus of FIG. 2, taken along line 3—3 of FIG. 2.
Figure 4:
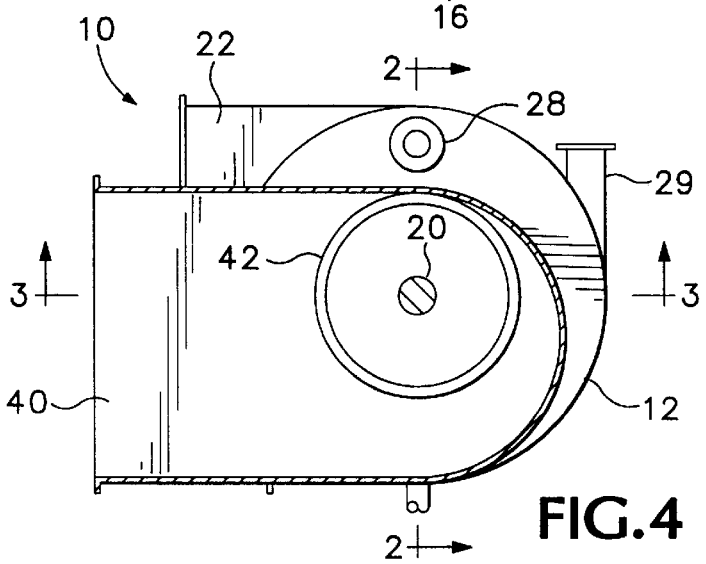
FIG. 4 is a partial top cross-sectional view of the cyclonic processing apparatus of FIG. 2 taken along line 4—4 of FIG. 2.

In a preferred embodiment having an application in the processing of hog fuel for a hog fuel boiler, chamber 13 has a height 80 (FIG. 3) of 2.7 meters (9 feet) and a diameter 82 (FIG. 3) of 1.8 (6 feet). Baffle 18 has a height 84 (FIG. 3) of 1.7 meters (5.6 feet) and tapers inwardly from a bottom diameter 86 (FIG. 3) of 1.4 meters (4.6 feet) to a top diameter 88 (FIG. 3) of 0.8 meters (2.6 feet). Air inlet 22 is 0.3048 meters (1 foot) wide and 1.26 meters (4.2 feet) high.

The parameters defining apparatus 10 operation for the processing of hog fuel are listed in Table 1. As noted in the Background Of The Invention section, hog fuel is a mixture of bark pieces and wood chips that is used to power hog fuel boilers in the lumber industry. The inconsistency of the moisture content and fragment size has been quite problematic for the operation of hog fuel boilers. A sudden mass of very wet hog fuel or a clump of sawdust mixed in with the hog fuel may put out the fire in the hog fuel boiler.

Milling paddles 48 also help to dry fragments through high speed collisions, which drive water off of the fragments The larger fragments, which have only fallen through the vortex, have a higher and less consistent moisture content. The smaller fragments are remixed with the larger fragments to bring greater consistency and lower moisture content to the hog fuel. The particles are kept separate and may be used to power a specialized wood particle burner. In this manner a more consistent fuel is fed into the hog fuel boiler and every portion of the hog fuel is used productively.

Another application for apparatus 10 is the processing of the plastic, one quart oil containers described in the Background of the Invention Section. Vortex 25 dries these containers as they are milled (broken into subfragments) by milling paddles 48. The heavier subfragments, which are

TABLE 1

| Criteria | Design | Range | Limit |
|---|---|---|---|
| Operating Temperature | 232° C. (450° F.) | 176–343° C. (350–650° F.) | 454.5° C. (850° F.) |
| Boiler Exhaust Inlet Temperature | 232° C. (450° F.) | 176–287° C. (350–550° F.) | 454.5° C. (850° F.) |
| Ambient Inlet Temperature | 15.5° C. (60° F.) | 6.5–38.6° C. (20–100° F.) | 6.5° C. (20° F.) |
| Outlet Temperature | 165.5° C. (330° F.) | 121–204.5° C. (250–400° F.) | 454.5° C. (850° F.) |
| Material Feed Rate g/s (lb/hr) | 126 (1,000) | 63.7–151.2 (500–1,200) | 151.2 (1,200) |
| % Material Inlet Moisture | 60 | 55–65 | 65 |
| % Material Exit Moisture - Bottom Exit | 50 | 45–55 | 65 |
| % Material Exit Moisture - Skimmer Exit | 35 | 34–36 | 65 |
| % Material Exit Moisture - Particle Capture Tube | 35 | 34–36 | 65 |
| Moisture Removed g/s (lb/hr) | 12.6 (100) | N/A | N/A |
| Feed Material Sizing/Separation | | | |
| % Particle Capture Tube Exit size ≦ 20 μm | 5 | 2.5–10 | 100 |
| % Skimmer Exit 20 μm ≦ size ≦ 1.3 cm (0.5") | 25 | 15–40 | 100 |
| % Bottom Exit size ≦ 1.3 cm (0.5") | 70 | 50–70 | 100 |
| Moisture from Boiler Exhaust g/s (lb/hr) | 94.6 (750) | 63.1–94.6 (500–750) | 94.6 (750) |
| Moisture from Ambient Air g/s (lb/hr) | 50.45 (400) | 44.1–56.7 (350–450) | 63.6 (500) |
| Chamber Explosive Gas | N/A | N/A | N/A |
| Boiler Exhaust Air Volume Rate $M^3/s$ ($ft^3/min$) | .89 (1,890) | .7–.94 (1,500–2,000) | 7.1 (15,000) |
| Material Blower Air Volume Rate $M^3/s$ ($ft^3/min$) | .56 (1,200) | .56 (1,200) | .56 (1,200) |
| Circulating Blower Air Volume Rate $M^3/s$ ($ft^3/min$) | 4.7 (10,000) | 4.7 (10,000) | 4.7 (10,000) |
| Burner M Joule (Btu) Input | 1.0 (1mm) | 2.25–1.0 (250k–1mm) | 1.0 (1mm) |
| Chamber Velocity M/s (FPM) | 15.25 (3,000) | 12.7–17.8 (2,500–3,500) | 17.8 (3,500) |

Cyclonic apparatus 10 not only dries hog fuel but separates out the saw dust (particles smaller than 20 μm [0.8 mil] in average diameter) via particle capture tube 28, the smaller fragments (between 20 μm [0.8 mil] and 1.3 cm [0.5 inches] in average diameter) via side exit skimmer 24, and the larger fragments (larger than 1.3 [0.5 inches] cm in average diameter) from bottom discharge opening 16. Both the sawdust and the smaller fragments are dried to a consistent moisture content (as listed in Table 1) because they have been suspended in the vortex until reaching the height of exit skimmer 24 or capture tube 28. During processing some of the large fragments are broken apart by milling paddles 48. composed of the container substance, exit through skimmer 24, whereas the lighter label substance subfragments exit through adjustable L-shaped particle capture tube 28. In this manner the containers are dried, milled and separated into their constituent substances in one continuous cyclonic processing operation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method of mixing a first fragmentary material with a second fragmentary material, said method comprising:

(a) providing a cyclonic mixing apparatus, including a substantially vertical chamber having a top vent, an air inlet, a first unprocessed fragments inlet, a second unprocessed fragments inlet and a first processed fragments outlet;

(b) introducing a gas into said air inlet and creating an upwardly spiraling vortex of said gas within said chamber; and (c) introducing a first class of fragmentary material into said cylindrical chamber through said first unprocessed fragments inlet and introducing a second class of fragmentary material into said cylindrical chamber through said second unprocessed fragments inlet, mixing said first and second fragmentary material together to form a fragmentary material mixture, and discharging said mixture from said apparatus through said first processed fragments outlet.

2. A method of processing fragmentary material to a first range of aerodynamic buoyancy said method comprising:

(a) providing a cyclonic processing apparatus, including a substantially vertical chamber having a top vent, an air inlet, a first unprocessed fragments inlet, a first processed fragments outlet, a baffle disposed radially centrally within said chamber and a baffle vertical position adjustment apparatus;

(b) adjusting the vertical position of the baffle;

(c) introducing air into said air inlet and creating an upwardly spiraling vortex of said air within said chamber;

(d) introducing said fragmentary material into said chamber through said unprocessed fragments inlet;

(e) suspending said fragmentary material in said vortex and vertically stratifying said material upwardly according to decreasing aerodynamic buoyancy while radially stratifying said material outwardly so that air at the center of said vortex is more free of said material than air at the periphery of said vortex;

(f) discharging said fragmentary material conforming to said first range of aerodynamic buoyancy from said chamber through said first processed fragments outlet; and (g) discharging said air at the center of said vortex from said chamber through said top vent.

3. A method of processing raw fragmentary material having a first aerodynamic buoyancy range to produce finished fragmentary material having a second aerodynamic buoyancy range, comprising:

(a) providing a cyclonic processing apparatus including:

(i) a substantially vertical chamber having a top vent, an air inlet, an unprocessed fragments inlet and a processed fragments outlet positioned above said air inlet;

(b) introducing air into said air inlet and creating an upwardly spiraling vortex of said air within said chamber;

(c) introducing said raw fragmentary material into said vertical chamber through said unprocessed fragments inlet;

(d) suspending said fragmentary material in said vortex;

(e) causing said fragmentary material to rise in said vortex by increasing the aerodynamic buoyancy of said fragmentary material until it rises to the vertical position of said processed fragments outlet; and (f) discharging said finished fragmentary material having said second aerodynamic buoyancy range through said processed fragments outlet.

4. The method of claim 3 wherein the raw fragmentary material is moisture bearing and said air blown into said air inlet has been heated and step (e) more specifically comprises drying said fragmentary material to a moisture content range corresponding to said second aerodynamic buoyancy range.

5. The method of claim 3 wherein said cyclonic processing apparatus includes a second processed fragments outlet and further comprising mutually separating a first class of processed fragmentary material having said first range aerodynamic buoyancy and a second class of fragmentary material having a second range of aerodynamic buoyancy by discharging said first class of fragmentary material from said first processed fragments outlet and discharging said second class of material from said second processed fragments outlet.

6. The method of claim 3 wherein said cyclonic processing apparatus includes a milling paddle projecting inwardly into said vertical chamber, and further comprising milling said fragmentary material by driving it into said milling paddle with said vortex.

7. The method of claim 3 wherein said cyclonic processing apparatus includes a bottom exit opening and further comprising discharging dense fragments through said bottom exit opening.

8. The method of claim 3 further comprising providing a recirculation conduit linking said top vent to said air inlet and recirculating said air discharged through said top vents to said air inlet.

9. The method of claim 3 wherein said air inlet and said first unprocessed fragments inlet are the same inlet.

10. The method of claim 3 wherein said processed fragments outlet is vertically adjustable and said method further includes vertically adjusting said processed fragments outlet.

11. A method of drying a raw moisture bearing combustible fragmentary material in preparation for combustion, comprising:

(a) providing a cyclonic processing apparatus including:

(i) a substantially vertical chamber having a top vent, an air inlet, an unprocessed fragments inlet, a processed fragments outlet and a bottom outlet;

(b) introducing heated air into said air inlet and creating an upwardly spiraling vortex of said heated air within said chamber;

(c) introducing said raw moisture bearing combustible fragmentary material into said vertical chamber through said unprocessed fragments inlet;

(d) suspending at least a portion of said raw moisture bearing combustible fragmentary material in said vortex; and (e) mixing together said portion of fragmentary material and an additional portion of said fragmentary material after exiting said processing apparatus to form a fuel mixture;

(f) discharging said portion of said combustible fragmentary material through said processed fragments outlet wherein said additional portion of said fragmentary material falls through vortex of heated air and falls through said bottom outlet.

12. A method of drying a recyclable moisture bearing raw fragmentary waste product, comprising:

(a) providing a cyclonic processing apparatus including:

(i) a substantially vertical chamber having a top vent, an air inlet, an two unprocessed fragments inlet, a processed fragments outlet;

(b) introducing heated air into said air inlet and creating an upwardly spiraling vortex of said heated air within said chamber;

(c) introducing said recyclable moisture bearing raw fragmentary waste product into said vertical chamber through said unprocessed fragments inlet;

(d) suspending at least a portion of said recyclable moisture bearing raw fragmentary waste product in said vortex; and (f) discharging said portion of said recyclable fragmentary waste product fragmentary material through said processed fragments outlet.

13. The method of claim 12 wherein said processing apparatus is further equipped with milling protrusions projecting into said chamber and wherein said method further comprises contacting said milling protrusions with said fragmentary material to effect a physical change in said fragmentary material.

14. The method of claim 13 wherein processing apparatus includes an additional processed fragments outlet and wherein said method includes discharging an additional portion of said fragmentary material through said additional processed fragments outlet.

* * * * *